US005692551A

United States Patent [19]

Blunt et al.

[11] Patent Number: 5,692,551

[45] Date of Patent: Dec. 2, 1997

[54] WINDOW SECURITY GUARD

[76] Inventors: JoAnn Blunt, 440 Glenwood, Youngstown, Ohio 44502; Nannie M. P. F. Cunningham, 2314 Scottwood, Toledo, Ohio 43620; Kathleen J. Konnert, 2515 108th St., Toledo, Ohio 43611

[21] Appl. No.: 117,691

[22] Filed: Sep. 7, 1993

Related U.S. Application Data

[63] Continuation of Ser. No. 938,817, Sep. 1, 1992, abandoned.

[51] Int. Cl.[6] ..... E06B 3/92

[52] U.S. Cl. ..... 160/136; 160/10

[58] Field of Search ..... 160/136, 137, 160/138, 139, 140, 141, 142, 143, 144, 145, 146, 147, 148, 149, 150, 151, 152, 153, 154, 155, 156, 157, 158, 159, 160, 161, 162, 163, 164, 165, 10; 49/55, 141, 13, 14

[56] References Cited

U.S. PATENT DOCUMENTS

| | | | |
|---|---|---|---|
| 1,067,267 | 7/1913 | Newpher | 160/160 |
| 1,450,117 | 3/1923 | Rush | 160/136 |
| 1,502,833 | 7/1924 | Kitzelman | 160/160 |
| 1,572,763 | 2/1926 | Carr | 160/136 |
| 3,058,517 | 10/1962 | Jacobs et al. | 49/57 |
| 3,338,289 | 8/1967 | Catalano | 160/161 |
| 3,417,805 | 12/1968 | Kaufman et al. | 160/152 |
| 3,506,056 | 4/1970 | Quinones et al. | 160/160 |
| 4,038,800 | 8/1977 | Daley | 49/55 X |
| 4,164,095 | 8/1979 | Musacchia | 49/141 X |
| 4,304,070 | 12/1981 | Musacchia | 49/13 X |
| 4,452,010 | 6/1984 | Whittington et al. | 49/141 X |
| 4,587,759 | 5/1986 | Gray | 49/50 |
| 4,593,492 | 6/1986 | Lumenello | 49/57 |
| 4,685,316 | 8/1987 | Hicks et al. | 49/141 X |
| 4,937,556 | 6/1990 | Scott et al. | 49/13 X |
| 5,018,302 | 5/1991 | Kluge | 49/56 |

FOREIGN PATENT DOCUMENTS

| | | | |
|---|---|---|---|
| 2161197 | 1/1986 | United Kingdom | 160/136 |

*Primary Examiner*—David M. Purol
*Attorney, Agent, or Firm*—Jerry W. Semer

[57] ABSTRACT

This invention is a window security guard that can be mounted by a do it yourself individual in a window. The security guard is designed so that it can be decorated to meet the decor of the room where it is placed. The security guard has a collapsible grill that is placed in the window to keep burglars from entering the home. The grill is collapsible so that the security guard can easily be pushed aside and a person can escape through the window in times of emergency. The collapsible grill is attached to a mounting member that has a rectangular box-like shape that can be easily bolted to the wall at the side of the window. On the other side of the window the locking member can be easily bolted to the inside wall. The grill contains a simple locking device that is a bar attached to the grill with an opening in the end. The bar fits through an opening in the locking member and telescopes into an U-shape locking bracket within the locking member. An opening in the U-shape mounting bracket lines up with the opening in a bar and a clevis pin is placed within. Thus, the security guard in times of emergency can be open by removing the clevis pin and pushing back the grill.

15 Claims, 6 Drawing Sheets

WINDOW SECURITY GUARD

This is a continuation of application Ser. No. 07/938,817 filed on Sep. 1, 1992 now abandoned.

FIELD OF THE INVENTION

This invention relates to a window security guard for preventing unauthorized entry into a building through the window and more particularity to a window security guard that can be put in by a do it yourself a person and that can prevent an unauthorized entry into a building but allows occupants in the building to easily escape in time of an emergency.

BACKGROUND OF THE INVENTION

Windows of buildings, especially ground level windows, are often easily open or broken to allow burglars to gain entry to apartment, home or business. This problem is particularly noticeable in high crime and urban areas.

Most attempts to secure windows from unauthorized entry have utilized fixed window grills such as those shown in U.S. Pat. No. 4,121,378 to Wahl and U.S. Pat. No. 1,634,843, to McLane. Fixed window grills are often difficult if not impossible to remove in an emergency situation requiring quick exit through the window. As a result, these designs are not practical for a home and in most areas the building code forbids such design. Thus, there is a need for window guards that will prevent unauthorized entry to a building but that can be easily opened from the inside the building in the event of an emergency. It is an object of this invention to provide a window guard that can be opened in times of emergency but will inhibit entry through the window from outside the building. Further, it is an additional object of this invention to provide a window guard that is aesthetically pleasing when viewed from the inside the window and fits with the decor of the home.

Further, the inventor wishes to make this window guard easily accessible to most individuals and thus enable an individual to put the window guard within the home themselves. Therefore, it is an object of this invention to make the window guard that can be easily mounted so that most individual can easily do the work to place the guard within their homes. The window guard must also be inexpensive and easy to manufacture.

In times of fire, especially at night, it is often hard to find the window to escape from in a smoke filled non-lit room. Therefore, it is an objective of this invention to have a safety light that lights upon the detection of smoke and that this light will lead an individual to the latch so that the grill can easily be opened.

It is a further objective of the invention to provide a window guard that fits the decor of the home. This is accomplished by making the sides flat so that they can be easily painted or wallpapered.

SUMMARY OF THE INVENTION

This invention is a window or opening security guard that can be easily mounted by a do it yourself individual in a window or opening. The security guard is designed so that it can be decorated to meet the decor of the room where it is placed. The security guard has a collapsible grill that is placed in the window to keep burglars from entering the home. The grill is collapsible so that the security guard can easily be pushed aside and a person can escape through the window in times of emergency. The collapsible grill is attached to a mounting member that has a rectangular box-like shape that can be easily bolted to the wall at the side of the window to covered by the grill. On the other side of the window to be covered by the grill is a locking mounting member that also can be easily bolted to the inside wall on the other side of the window. The grill contains a simple locking device that is a bar attached to the grill with an opening in the end. The bar fits through an opening in the locking member and telescopes into an U-shape locking bracket within locking mounting member. An opening in the U-shape mounting bracket lines up with the opening in a bar and a pin is placed within. Thus, the window in times of emergency can be easily open by removing the pin and pushing back the grill and a person can escape through the window. Further the inventor has placed a light or fluorescent material near the pin and lock position so an individual can easily find the pin in a dark or smoke filled room. The invention can also have a smoke alarm integrated into it so that when the smoke alarm goes off the light will light so the individuals can find his way to safety even in a smoky room.

DETAILED DESCRIPTION OF THE PREFERRED EMBODIMENT

Figure 1:
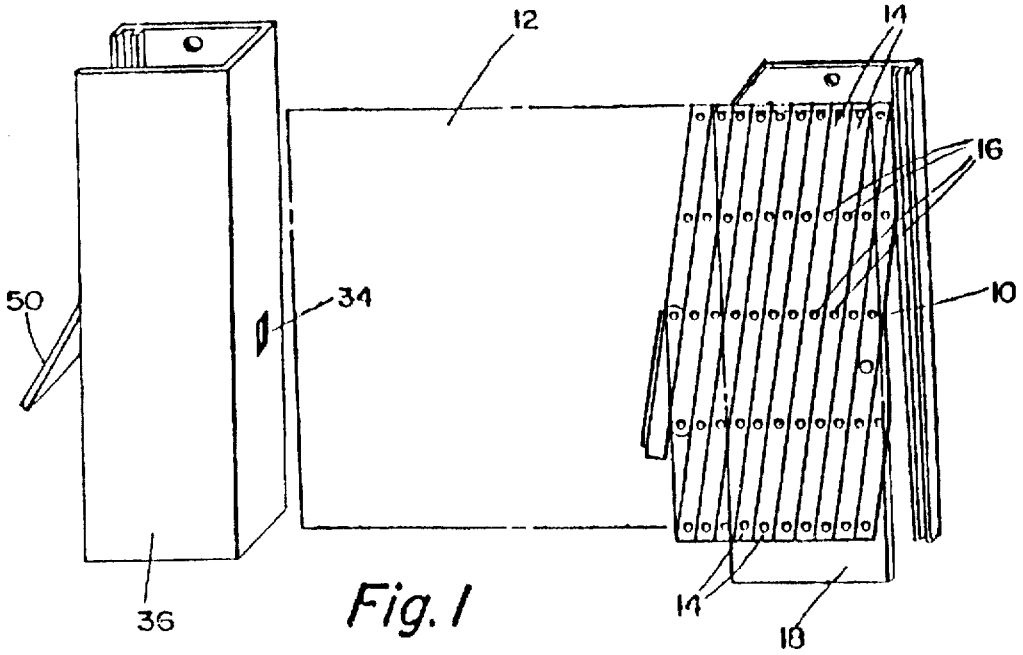
FIG. 1 is a front view of a window with the security guard in place and the grill expanded.
Figure 2:
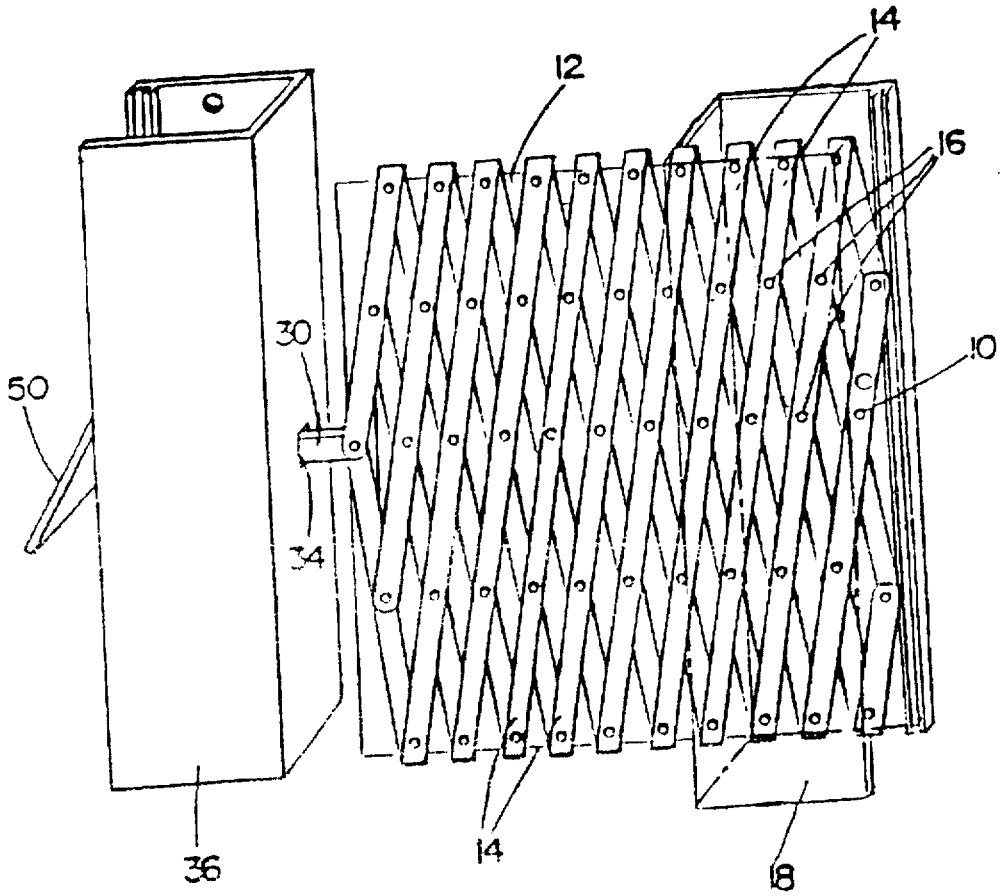
FIG. 2 is a front view of the same window with the security guard in place and the grill collapsed.

FIG. 1 shows the invention in place over an window with the grill 10 in the position of securing the window 12. FIG. 2 shows the invention in position when the grill 10 is collapsed or pushed back so an individual can easily escape through the window 12.

In the preferred embodiment grill 10 is made of several flat bars 14 that are attached pivotally to each other at their ends and at equally spaced interior points by pins 16 in such a way that when the grill 10 is fully extended as in FIG. 1, the bars 14 form a cross hatch or diamond pattern. The opening between the bars should be kept to a minimum so that an intruder can not place any part of his body through the bars. Due to the fact that the bars 14 are pivotally attached to each other they can be easily pushed back as shown in FIG. 2 so that an individual can easily escape through the window 12. These bars 14 could be also attached in other patterns that are known in the art. U.S. Pat. No. 3,058,517 to Mark Jacobs and Paroserri shows some other patterns that could be used for this bar assembly. This patent is incorporated by reference. The bars can also be decorated to fit the decor of the room.

Figure 3A:
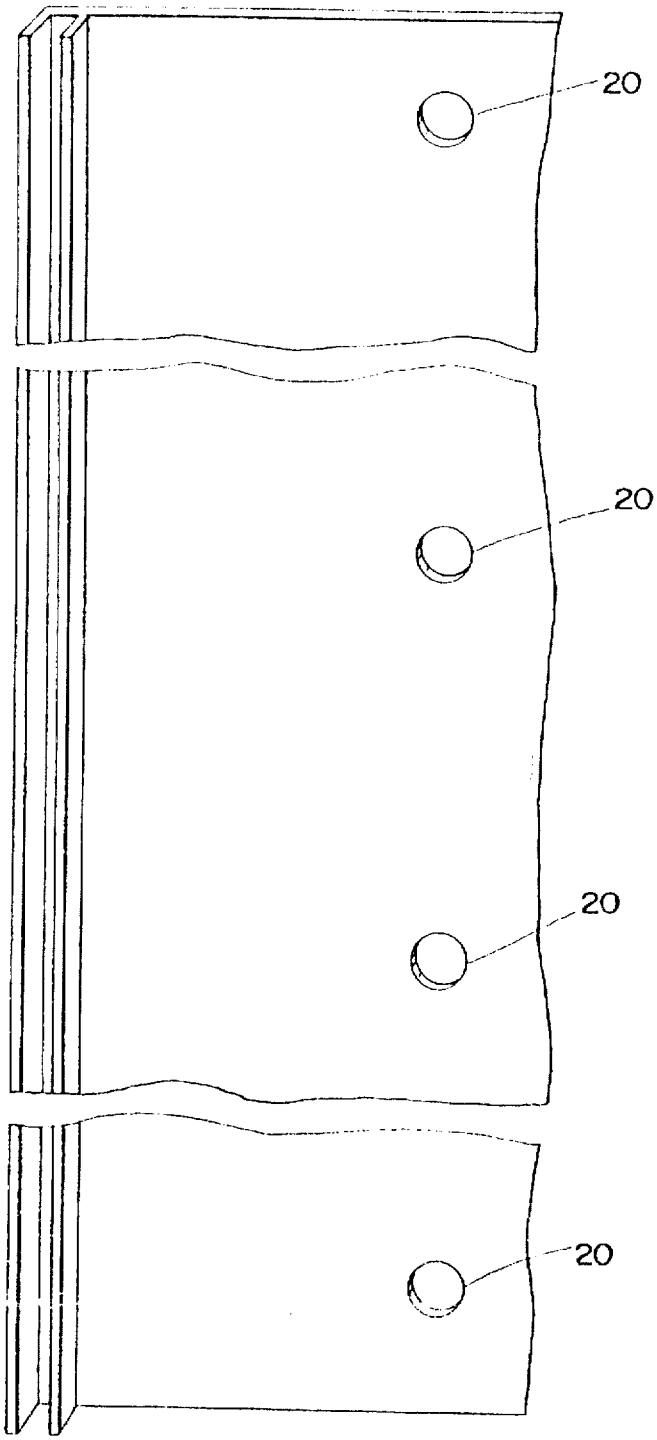
FIG. 3A is a view of the inside of the side mounting channel.
Figure 3:
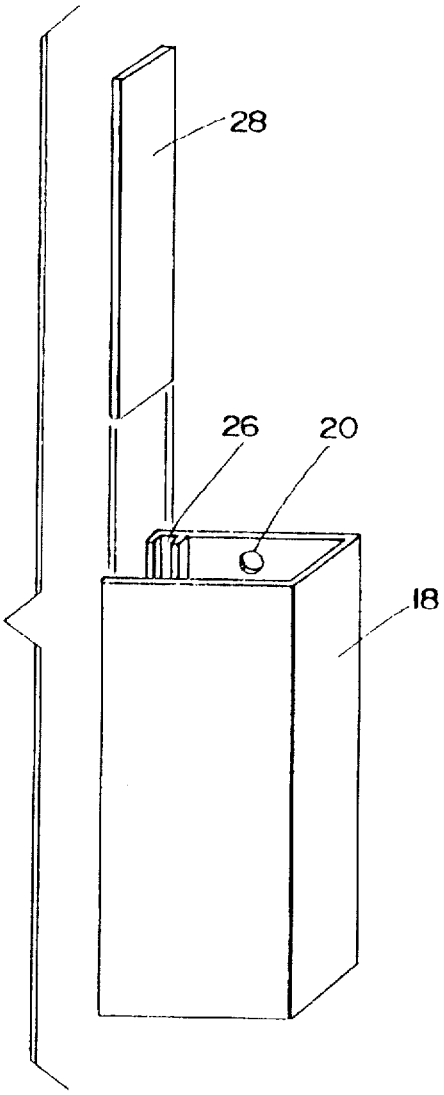
FIG. 3 is a perspective view of the side mounting channel.

One end of the grill 10 is attached to side mounting channel 18. Side mounting channel 18 is shown more specifically in FIG. 3. FIG. 3 shows that the side mounting channel 18 has a rectangular box like shape with one side open and the grill 10 is attached to the side opposite the open side. FIG. 3A shows that on the back side of the side mounting channel 18 are four openings 20. Bolts are placed through these openings 20 to mount the side mounting channel 18 to a wall at the side of the window for which the grill 10 is to cover. The front sides of the side mounting channel 18 are flat. This is to allow these sides to be wallpapered or painted or decorated in a way to fit the room decor. A decorated plate could also be attached to the sides by magnetic means or glue. The side of the side mounting channel 18 opposite where the grill 10 is attached can be opened. The side is formed by a plate 28 that fits within an U-shaped channels 26 on the edges of this side of the side mounting channel 18 as shown in FIG. 3 and 3A. The plate 28 can easily be pulled upward out of the U-shaped channels 26. This allows for easy access to the openings 20 and the bolts so that the invention can be easily mounted in a window. This system also allows for the side to be almost flat so it can be painted or wallpapered. Plate 28 can be easily painted or wallpapered.

Figure 4:
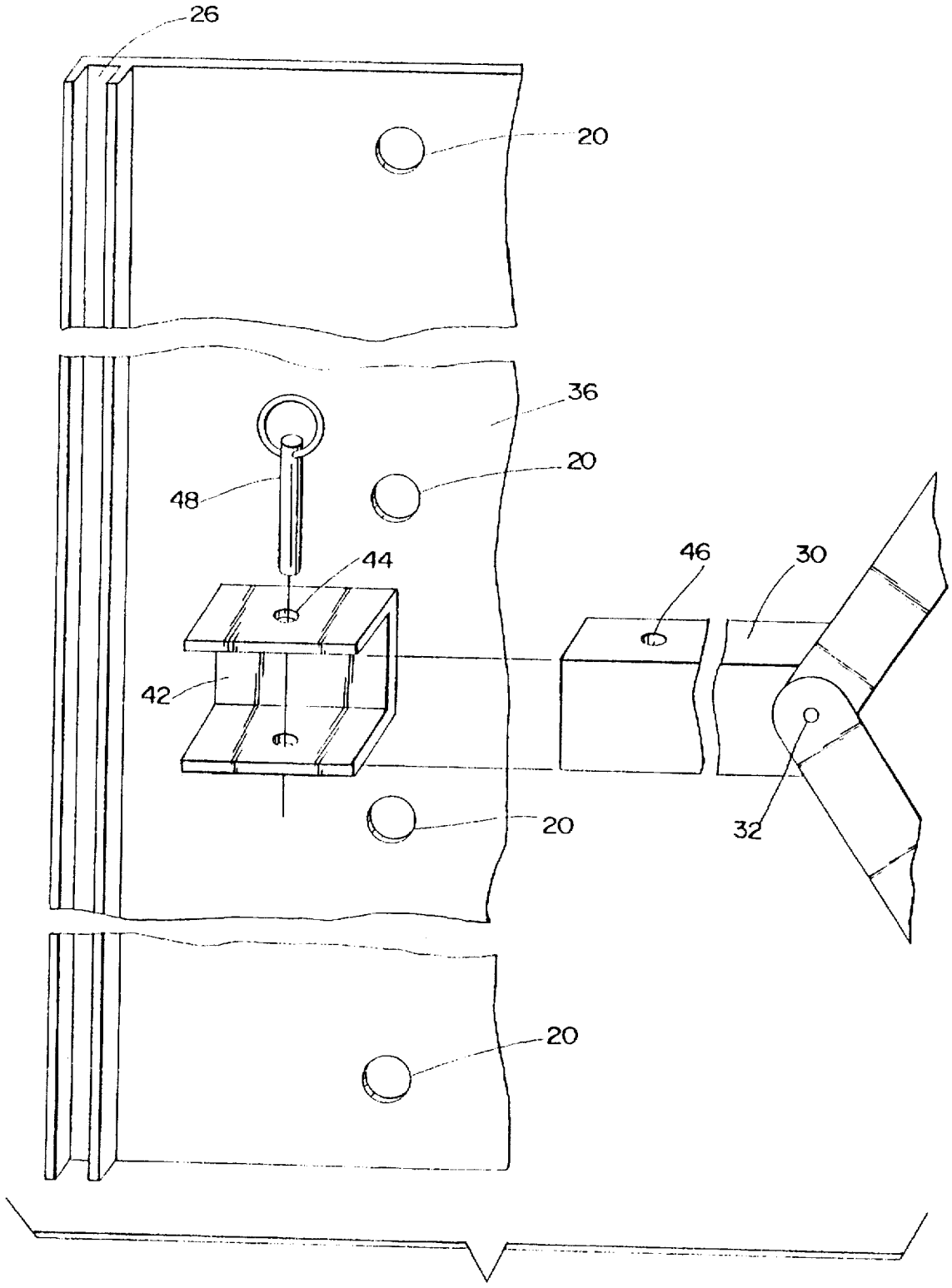
FIG. 4 is an exploded view of the locking means and the locking mounting channel.
Figure 4A:
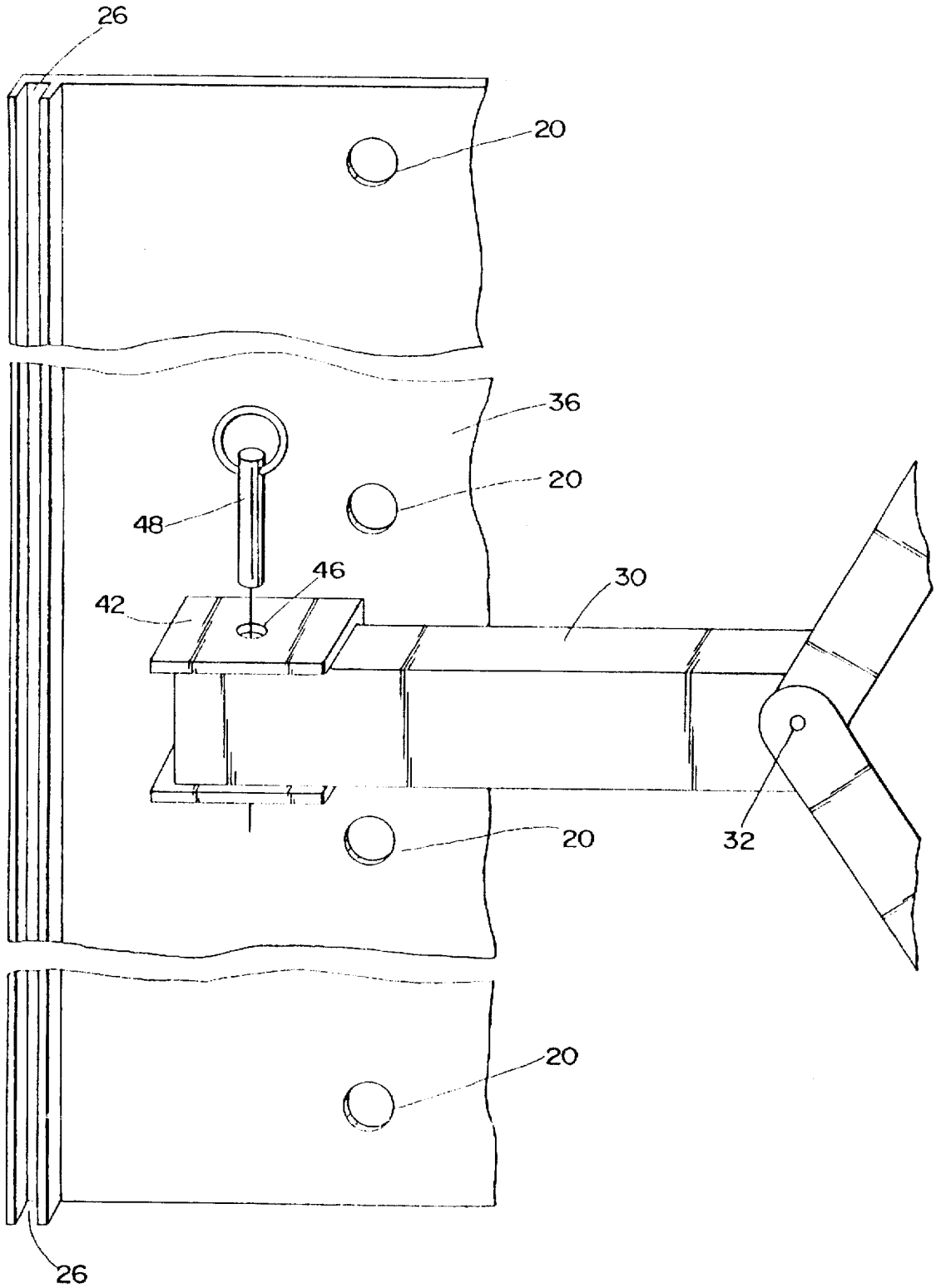
FIG. 4A is a view of the inside the locking mounting channel.
Figure 5:
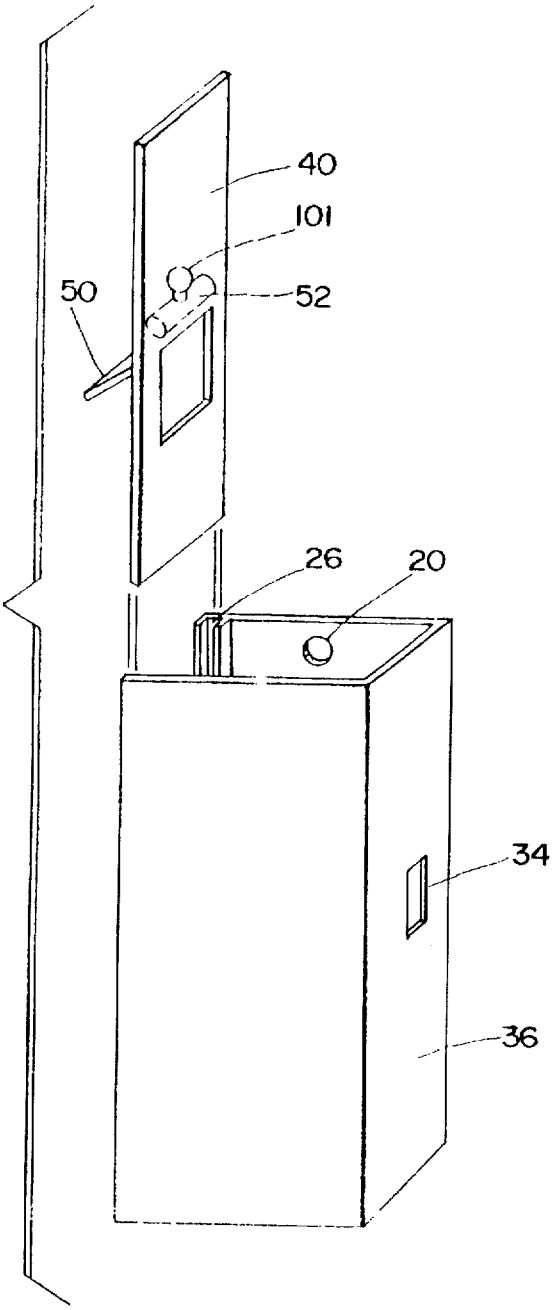
FIG. 5 is a perspective view of the locking mounting channel.

FIGS. 1, 2, 4 and 4A show the locking bar 30 attached to the opposite end of the grill 10 as the side mounting channel 18. The locking bar 30 is attached in the middle of the grill 10 and is attached to the grill 10 by a pin 32 as shown in FIG. 4 and 4A. FIG. 2 also shows that this locking bar 30 passes through slot 34 in the locking mounting channel 36. As showing in FIG. 5 the locking mounting channel 36 is also an elongated shaped box. Similar to the slide mounting channel 18, the locking mounting channel 36 has on its back, four openings 20 which through bolts can be placed so as to mount the locking mounting channel 36 on the opposite side of the window from the side mounting channel 18. The sides of the locking mounting channel 36 are flat. This allows the sides to be wallpapered or painted or decorated in a way to fit the room decor. Decorated plates could also be attached to the sides by magnetic means or glue. The side opposite the side with slot 34 can be opened. This side in the preferred embodiment is formed by a plate 40 that fits within U-shaped channels 26 on the edge of the locking mounting channel 36 as shown in FIGS. 4, 4A and 5. The plate 40 can easily be pulled upward and out of the U-shaped channels. This allows for easy access to the opening 20 and the bolts 26 so that the invention can be easily mounted in a window. This system also allows for the side to be almost flat so it can be painted or wallpapered. Plate 40 can be painted or wallpapered.

The locking bar 30 from the grill 10 passes through a slot 34 in the locking mounting channel 36 and within the locking mounting channel 36 passes into an U-shaped locking bar bracket 42 as shown in FIG. 4. The U-shaped locking bar bracket 42 is U-shaped and has an opening 44 at the top. When the locking bar 30 is in place, the locking bar 30 at one end has a hole 46 that is adapted to line up with and opening 44 in the U-shaped locking bar bracket 42. In the preferred embodiment a pin 48 is placed through the opening 44 in the U-shaped locking bar bracket 42 and through the hole 46 in the locking bar 30 to lock the grill 10 in place and make it secure from being open from the outside. In the preferred embodiment in plate 40 there is a small little door 50 from which when open one can access the pin 48, to pull it out of locking bar 36 or place it within.

Figure 6:
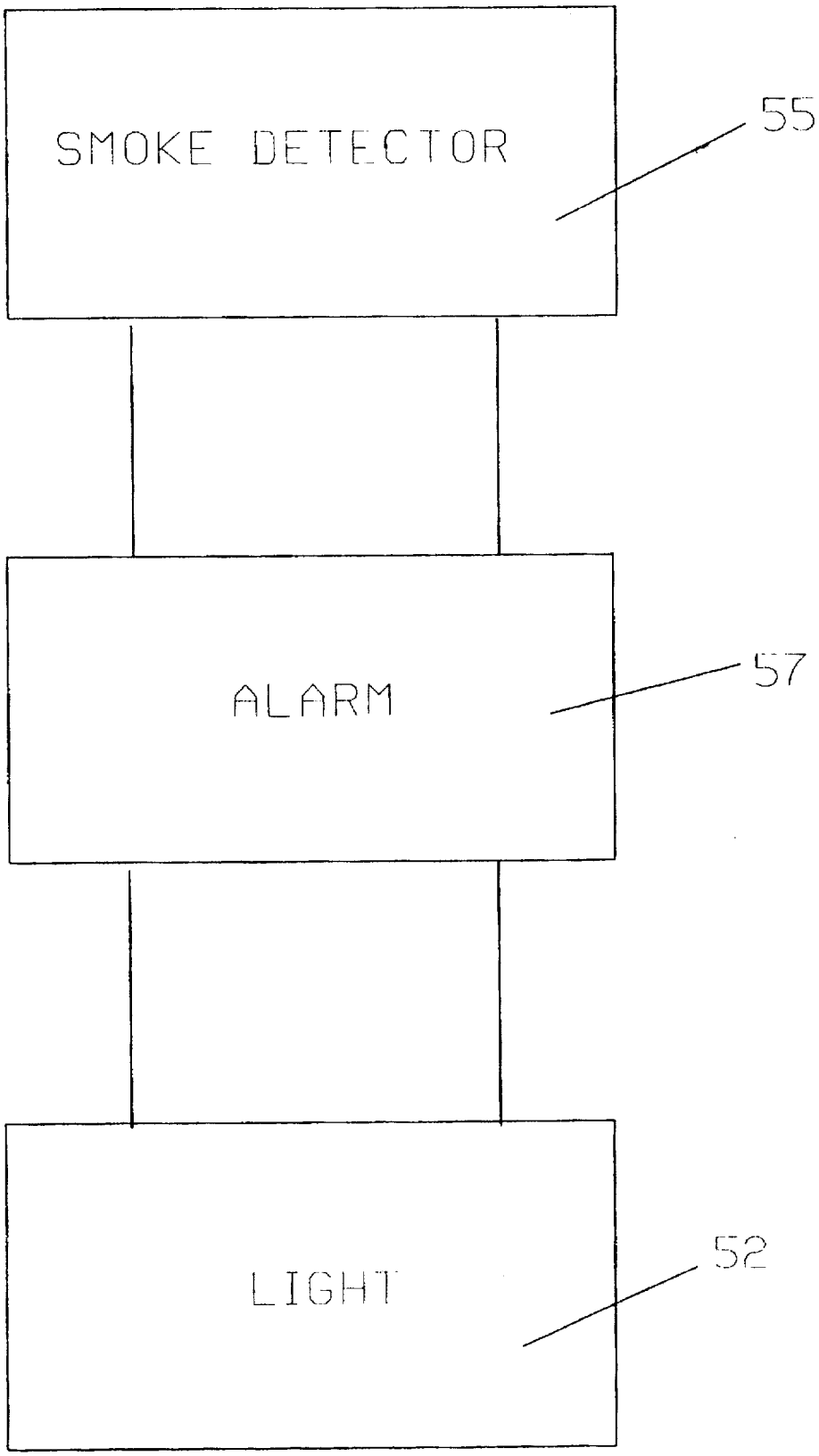
FIG. 6 is a flow chart of the wiring of the smoke alarm and the light.
Figure 7:
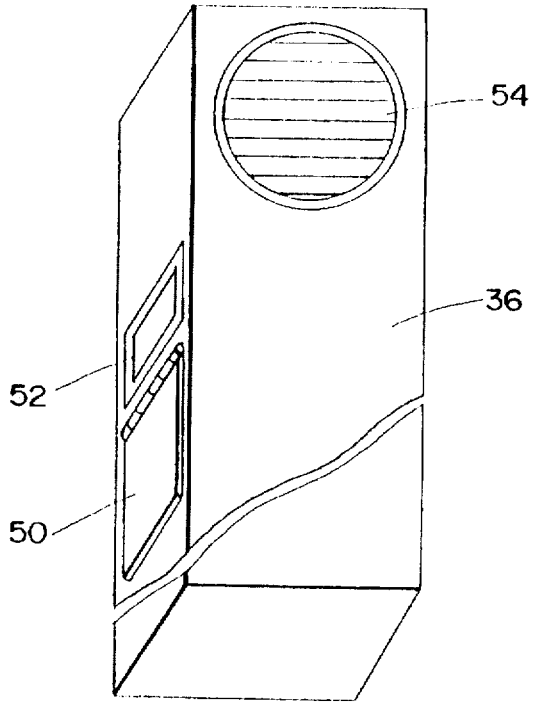
FIG. 7 is a perspective view of the locking mounting channel with the smoke alarm and the light in place.
Figure 8:
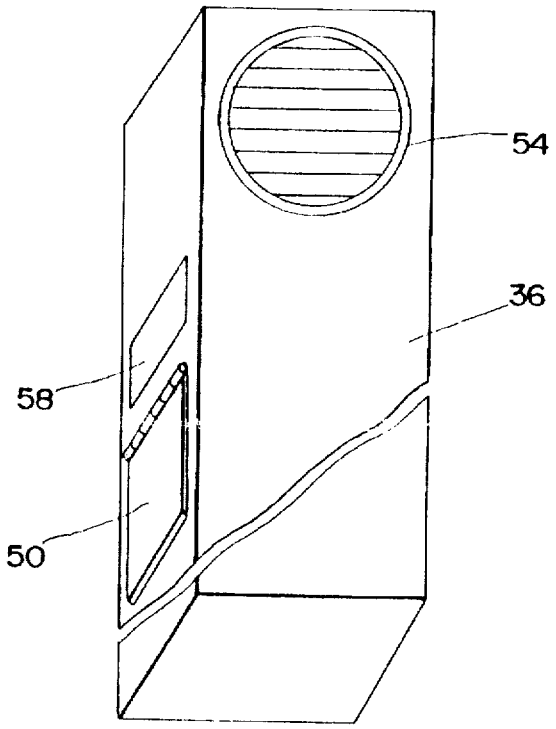
FIG. 8 is a perspective view of the locking mounting channel with the fluorescent strip and the smoke alarm.

Also in the preferred embodiment on plate 40 there is a light 52 that is near the door 50 so that at night or in case of an emergency one could easily find the door 50 to pull out the clevis pin 48 and pull back the grill 10. In the preferred embodiment this light 52 is powered by battery 101. A light 52 can also be placed inside the locking mounting channel 36 so that one can see pin 48 at night. The inventor has also placed a smoke alarm 54 as shown in FIG. 7 within the device. The smoke alarm 54 is design to go off when there is a fire and light up the light 52 to ensure that individuals within the home in case of fire can find their way to the pin 48 and out the window. The wiring of the smoke alarm is shown by the flow chart FIG. 6. When the smoke detector 55 detects fire, it sends a signal to the alarm 57 that makes an audible sound and to the light 52 to turn on the light 52. The light 52 upon receiving the signal lights and stays on until it is turned off. The light 52 over the door 50 can be design to be on at all times or can be designed to only be on when the smoke alarm 54 goes off for a fire or can be designed to be on at night. A simple switch can be used which allows the light 52 to be on or off. A timer can also be used so that the light come on in the evening and goes off during the day. Also a light sensing device could be used. When this device senses that the level of light in the room drops below a certain level it would turn on the light 52. In another embodiment of the invention, shown in FIG. 8, the light 52 has been replaced with fluoresce material 58 to make invention less expensive to manufacture. The luminescence of fluorescent material 58 placed above door 50 easily leads one in emergency situation to the door 50.

The invention can be used to protect not only windows in the house but also windows in offices, stores, cars, vans, boats, and other vehicles. Also, the invention can be used to protect large open areas such as a garage. There are times when an individual wishes to leave his garage door open but still secure the garage. Side mounting channel 18 and locking mounting channel 36 could be mounted on the sides of the garage beside the garage door and the grill 10 could be pulled across the opening formed by the open garage door and locked. When one wanted to use the garage the grill 10 could be pushed back.

The invention has been designed so it can be placed over a window or open area by an average do it yourself person. All that is necessary is that on one side of the window the side mounting channel 18 with the grill 10 attached is mounted on the wall with bolts. On the other side of the window the locking mounting channel 36 is lined up with the side mounting channel 18 and mounted on the wall with bolts. The mounting thus is very simple and can be done by any average individual.

Changes in modified in the specifically described embodiment can be carried out without the departing from the scope of the invention that is intended to be limited only by the scope of the appending claims.

What is claimed:

1. A window or opening security guard that secures a window or opening that has two sides comprising:

a. a collapsible grill; and, b. a means for mounting the collapsible grill on one side at the window or opening; and, c. a locking member with a front, back, two sides and an inside that is adapted to be mounted on the other side of the window from the means for mounting; and, d. a bar with two ends and one of said ends is attached to the grill and the other end has an opening; and, e. an opening in the locking member to allow the bar attached to the grill to pass through said opening; and, f. a u-shape locking bar bracket with a top on the inside of the locking member and, said u-shape bracket has an opening in its top and is adapted such that the bar attached to the grill can telescope within the u-shape bracket, and the opening in the bar attached to the grill matches up with the opening in the u-shape bracket; and, g. a pin adapted to fit through the opening in the u-shape bracket and into the opening in the bar; and, h. whereby the collapsible grill is locked to the locking member by the bar attached to the grill being placed in the u-shape bracket and the pin is placed through the opening in the bar attached to the grill and the opening in the u-shape bracket and when the collapsible grill is locked to the locking member the window or opening is secured and when the collapsible grill is unlocked the collapsible grill can be collapsed or pushed back to allow an individual to climb through said window or opening.

2. A window or opening security guard as in claim 1 wherein:

a. the means for mounting is a boxlike member with a back, a front and two sides one of which is open and the other is unopen and, the grill is attached to the unopen side and on the back are openings which are adapted to have bolts placed through for bolting said boxlike member to a wall at the side of the window or opening; and, b. a panel that is releasably attached to the open side of the box like member.

3. A window or opening security guard as in claim 1 further comprising:

a. a door in one of the sides of the locking member and said door is located such that the door can be opened and an individual can place his hand through the door and pull the pin that fits within the opening in the u-shape bracket and the bar attached to the grill and thus unlock the grill or a person could place the pin into the opening in the u-shape bracket and the opening in the bar attached to the grill and thus lock the grill.

4. A window or opening security guard as in claim 3 further comprising:

a. a means for illuminating the door so that an individual in an emergency situation could easily find the door to open the grill.

5. A window or opening security guard as in claim 4 wherein:

a. the means for illuminating is fluorescence material.

6. A window security guard as in claim 4 wherein:

a. the means for illuminating is a battery operated light.

7. A window or opening security guard as in claim 1 further comprising:

a. a smoke alarm attached to the security guard.

8. A window or opening security guard as in claim 1 wherein:

a. the locking member has an open side and in the back of the locking member are openings that are adapted to have bolts placed through for bolting said locking member to the wall.

9. A window or opening security guard as in claim 8 further comprising:

a. a panel that is releasably attachable to the open side of the locking member and said panel has a door that is adapted such that the door can be opened and an individual can pull the pin that fits within the opening in the u-shape bracket and the bar attached to the grill and thus unlock the grill or place the pin into the opening in the u-shape bracket and the opening in the bar attached to the grill and thus lock the grill.

10. A window or opening security guard as in claim 9 further comprising:

a. a means for illuminating the security device so that an individual in an emergency situation could easily find the door and open the collapsible grill.

11. A window or opening security guard as in claim 10 wherein:

a. the means for illuminating is a fluorescent material.

12. A window or opening security guard as in claim 10 wherein:

a. the means for illuminating is a battery operated light.

13. A window or opening security guard as in claim 12 further comprising:

a. a smoke alarm attached to the security guard.

14. A window or opening security guard as in claim 1 further comprising:

a. a means for allowing decoration of the security guard so that it fits the decor of a room in which it is placed.

15. A window opening or security guard as in claim 14 wherein:

a. the locking member and the means for mounting fronts and sides are flat so that an individual can decorate said security guard to fit the decor of the room.

* * * * *